US006525695B2

(12) United States Patent
McKinzie, III

(10) Patent No.: US 6,525,695 B2
(45) Date of Patent: Feb. 25, 2003

(54) RECONFIGURABLE ARTIFICIAL MAGNETIC CONDUCTOR USING VOLTAGE CONTROLLED CAPACITORS WITH COPLANAR RESISTIVE BIASING NETWORK

(75) Inventor: William E. McKinzie, III, Fulton, MD (US)

(73) Assignee: e-tenna Corporation, Laurel, MD (US)

( * ) Notice: Subject to any disclaimer, the term of this patent is extended or adjusted under 35 U.S.C. 154(b) by 0 days.

(21) Appl. No.: 09/845,393

(22) Filed: Apr. 30, 2001

(65) Prior Publication Data

US 2002/0167456 A1 Nov. 14, 2002

(51) Int. Cl.[7] ..... H01Q 13/10; H01Q 3/40
(52) U.S. Cl. ..... 343/756; 343/795
(58) Field of Search ..... 343/756, 700 MS, 343/909, 910, 787, 795, 833, 754, 755; 359/248

(56) References Cited

U.S. PATENT DOCUMENTS 6,175,337 B1 1/2001 Jasper, Jr. et al.

FOREIGN PATENT DOCUMENTS

| | | |
|---|---|---|
| WO | WO 99/50929 | 10/1999 |
| WO | WO 01/24313 A1 | 4/2001 |
| WO | WO 01/73891 A1 | 10/2001 |

OTHER PUBLICATIONS

R. J. King and K. S. Park, "Synthesis of surface reactances using grounded pin bed structure," *Electronics Letters*, vol. 17, 1981, pp. 52–53.

S. M. Sze, "Physics of Semiconductor Devices—Chapter 2.7.4 Varactor", published by Wiley & Sons, 1981, pp 114–122.

Ray. J. King, David. V. Theil, and Kwang S. Park, "The synthesis of surface reactances using an artificial dielectric," *IEEE Trans. Antennas and Propagation*, vol. AP–31, No. 3, May 1983, pp. 471–476.

R. M. Walser et al., "New smart materials for adaptive microwave signature control," *Proceedings of the Society of Photo–Optical Instrumentation Engineers* (*SPIE*), vol. 1916, 1993, pp. 128–134.

John C. Vardaxoglou, "*Frequency Selective Surfaces: Analysis and Design*," Research Studies Press Ltd, Copyright 1997, pp 1–9, 18–73, 116–152 and 221–273.

Daniel F. Sievenpiper, "High–impedance electromagnetic surfaces," Ph.D. dissertation, UCLA electrical engineering department, filed Jan. 1999.

D. Sievenpiper, L. Zhang, and E. Yablonovitch, "High–impedance electromagnetic ground planes," *IEEE Intl. MTT Symp.*, Jun. 13–19, 1999, Anaheim, CA.

(List continued on next page.)

*Primary Examiner*—Don Wong
*Assistant Examiner*—James Clinger
(74) *Attorney, Agent, or Firm*—Brinks Hofer Gilson & Lione

(57) ABSTRACT

A frequency reconfigurable artificial magnetic conductor (AMC) includes a ground plane, a spacer layer disposed adjacent the ground plane and a plurality of vias in electrical contact with the ground plane and extending from a surface of the ground plane in direction of the spacer layer. The AMC further includes a frequency selective surface (FSS) disposed on the spacer layer and including a periodic pattern of bias node patches alternating with ground node patches, the ground node patches being in electrical contact with respective vias of the plurality of vias, and components between selected bias node patches and ground node patches, the components having a capacitance which is variable in response to a bias voltage. A network of bias resistors between adjacent bias node patches provides the tuning voltage.

34 Claims, 8 Drawing Sheets

OTHER PUBLICATIONS

D. Sievenpiper, R. Broas, and E. Yablonovitch, "Antennas on high–impedance ground planes," *IEEE Intl. MTT Symp.*, Jun. 13–19, 1999, Anaheim, CA.

L. Zhang, N. G. Alexopoulos, D. Sievenpiper, and E. Yablonovitch, "An efficient finite–element method for the analysis of photonic bandgap materials," *IEEE Intl. MTT Symp.*, Jun. 13–19, 1999, Anaheim, CA.

Dan Sievenpiper, Lijun Zhang, Romulo F. Jimenez Broas, Nicolaos G. Alexopoulos, and Eli Yablonovitch, "High–impedance electromagnetic surfaces with a forbidden frequency band," *IEEE Trans. Microwave Theory and Techniques*, vol. 47, No. 11, Nov. 1999, pp. 2059–2074.

Ruey Bing Hwang and Song Tsuen Peng, "Guidance Characteristics of Two–Dimensionally Periodic Impedance Surface", *IEEE Trans. Microwave Theory and Techniques*, vol. 47, No. 12, Dec. 1999, pp. 2503–2511.

Rudolfo E. Diaz, James T. Aberle, and William E. McKinzie III, "TM mode analysis of a Sievenpiper high–impedance reactive surface," *IEEE Intl. Antennas and Propagation Symp.* Jul. 16–21, 2000, Salt Lake City, Utah. pp. 327–330.

M. Rahman and M. A. Stuchly, "Equivalent circuit model of 2D microwave photonic bandgap structures," *URSI National Radio Science Meeting*, Jul. 16–21, 2000, Salt Lake City, Utah, pp. 322.

G. Poilasne and E. Yablonovitch, "Matching antennas over high–impedance ground planes," *URSI National Radio Science Meeting*, Jul. 16–21, 2000, Salt Lake City, Utah, pp. 312.

H. Y. D. Yang, R. Kim and D. R. Jackson, "Surface–Wave Band Gaps and Leaky Modes On Integrated Circuit Structures With Planar Periodic Metallic Elements", IEE MTT–S Digest, Copyright 2000, pp 1521–1524.

R. B. Hwang, S. T. Peng and C. C. Chen, "Surface–Wave Suppression of Resonance–Type Periodic Structures", IEEE MTT–S Digest, Copyright 2000, pp 1525–1528.

Ben A. Munk, "*Frequency Selective Surfaces, Theory and Design*," John Wiley and Sons, New York, Copyright 2000, pp 26–62 and 279–314.

R. J. King and S. W. Cho, "Surface Impedance Planes", Dept. of Electrical and Computer Engineering, University of Wisconsin, Copyright 2000, 16 pages.

D. Sievenpiper, H. Hsu, J. Schaffner R. Garcia and S. Ontiveros, "Low Profile, Four Sector Diversity Antenna on High Impedance Ground Plane," *Eelectronics Lett.*, vol. 36, No. 16, 1999, 2 pages.

Keisuke Kageyama et al., "Tunable Active Filters Having Multilayer Structure Using LTCC", IEEE, Copyright 2001, 4 pages.

Dan Sievenpiper, Jim Schaffner, Bob Loo, Greg Tangonan, Rick Harold, Joe Pikulski and Ray Garcia, "Electronic Beam Steering Using A Varactor–Tuned Impedance Surface," *IEEE Antennas and Propagation Society Intl. Symp*, vol. 1, as presented at the IEEE Antennas and Propagation International Symposium in Boston, MA., Jul., 2001, pp. 174–177.

Briefing Charts in color as presented at the IEEE Antennas and Propagation International Symposium in Boston MA., Jul., 2001, 13 pages.

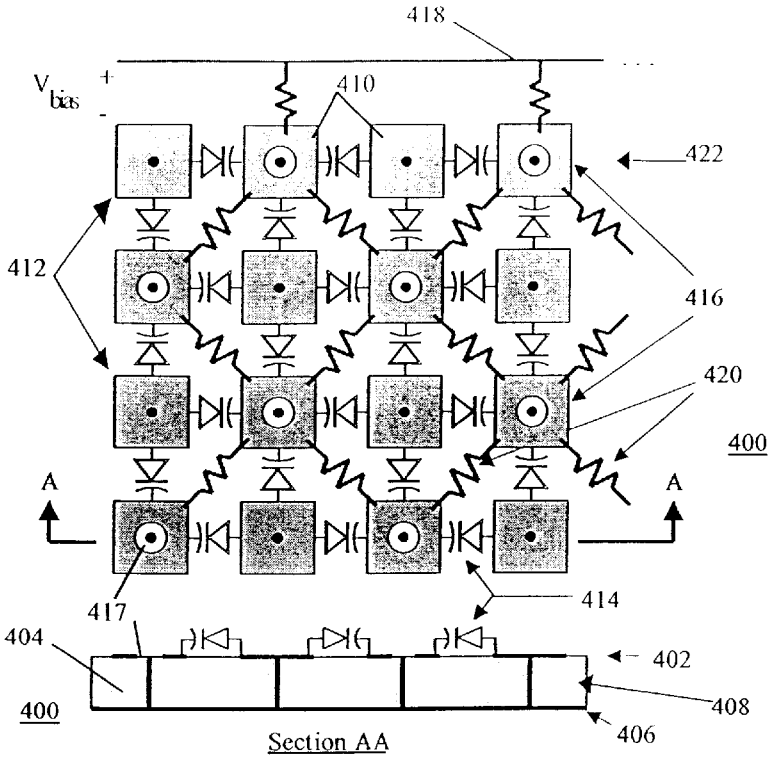
FIG. 4
FIG. 5
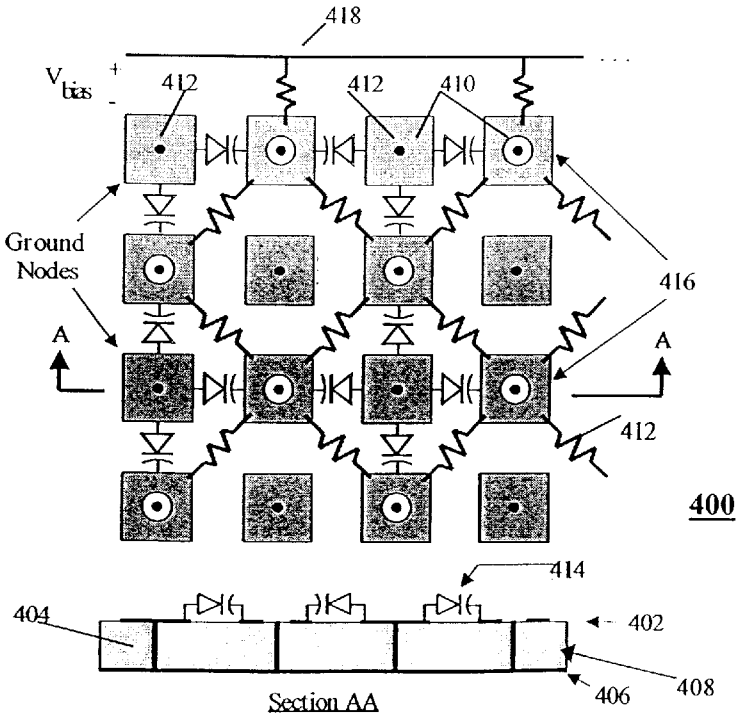
FIG. 6
FIG. 7

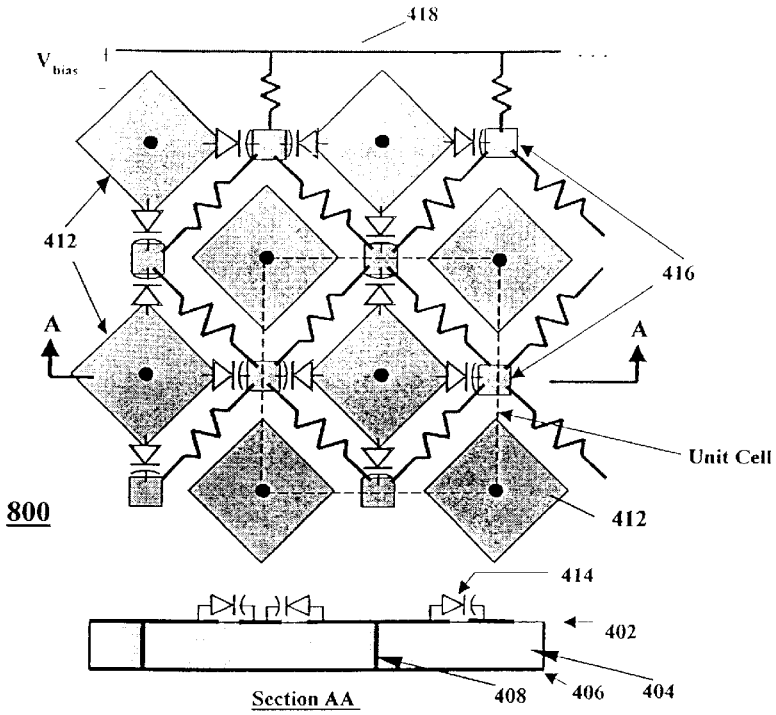
FIG. 8
FIG. 9
FIG. 16
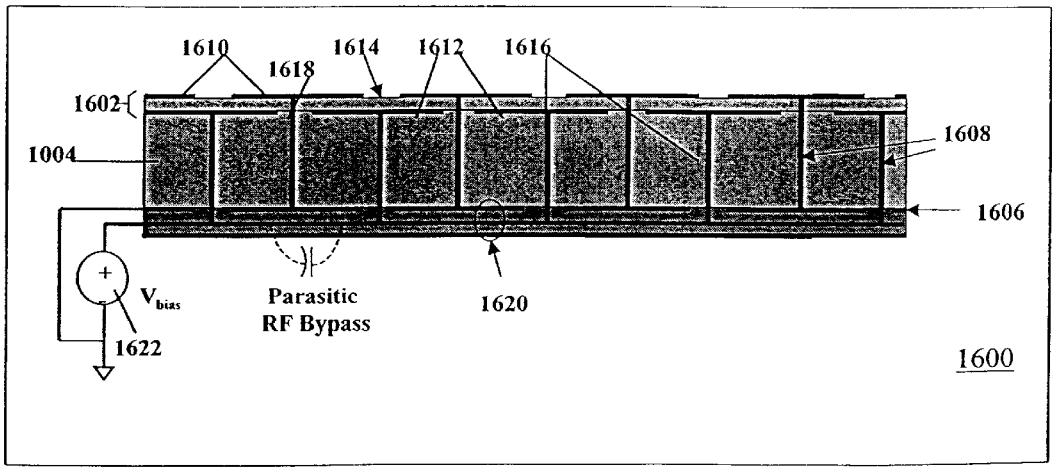

RECONFIGURABLE ARTIFICIAL MAGNETIC CONDUCTOR USING VOLTAGE CONTROLLED CAPACITORS WITH COPLANAR RESISTIVE BIASING NETWORK

RELATED APPLICATIONS

This application is related to U.S. Ser. No. 09/845,666 entitled RECONFIGURABLE ARTIFICIAL MAGNETIC CONDUCTOR, which is commonly assigned with the present application and filed on even date herewith.

BACKGROUND

The present invention relates to the development of reconfigurable artificial magnetic conductor (RAMC) surfaces for low profile antennas. This device operates as a high-impedance surface over a tunable frequency range, and is electrically thin relative to the wavelength of interest, λ.

A high impedance surface is a lossless, reactive surface, realized as a printed circuit board, whose equivalent surface impedance is an open circuit which inhibits the flow of equivalent tangential electric surface currents, thereby approximating a zero tangential magnetic field. A high-impedance surface is important because it offers a boundary condition which permits wire antennas (electric currents) to be well matched and to radiate efficiently when the wires are placed in very close proximity to this surface (<λ/100 away). The opposite is true if the same wire antenna is placed very close to a metal or perfect electric conductor (PEC) surface. It will not radiate efficiently. The radiation pattern from the antenna on a high-impedance surface is confined to the upper half space above the high impedance surface. The performance is unaffected even if the high-impedance surface is placed on top of another metal surface. The promise of an electrically thin, efficient antenna is very appealing for countless wireless device and skin-embedded antenna applications.

One embodiment of a thin, high-impedance surface 100 is shown in FIG. 1. It is a printed circuit structure forming an electrically thin, planar, periodic structure, having vertical and horizontal conductors, which can be fabricated using low cost printed circuit technologies. The high-impedance surface 100 includes a lower permittivity spacer layer 104 and a capacitive frequency selective surface (FSS) 102 formed on a metal backplane 106. Metal vias 108 extend through the spacer layer 104, and connect the metal backplane to the metal patches of the FSS layer. The thickness of the high impedance surface 100 is much less than λ/4 at resonance, and typically on the order of λ/50, as is indicated in FIG. 1.

The FSS 102 of the prior art high impedance surface 100 is a periodic array of metal patches 110 which are edge coupled to form an effective sheet capacitance. This is referred to as a capacitive frequency selective surface (FSS). Each metal patch 110 defines a unit cell which extends through the thickness of the high impedance surface 100. Each patch 110 is connected to the metal backplane 106, which forms a ground plane, by means of a metal via 108, which can be plated through holes. The spacer layer 104 through which the vias 108 pass is a relatively low permittivity dielectric typical of many printed circuit board substrates. The spacer layer 104 is the region occupied by the vias 108 and the low permittivity dielectric. The spacer layer is typically 10 to 100 times thicker than the FSS layer 102. Also, the dimensions of a unit cell in the prior art high-impedance surface are much smaller than λ at the fundamental resonance. The period is typically between λ/40 and λ/12.

Another embodiment of a thin, high-impedance surface is disclosed in U.S. patent application Ser. No. 09/678,128, entitled "Multi-Resonant, High-Impedance Electromagnetic Surfaces," filed on Oct. 4, 2000, commonly assigned with the present application and incorporated herein by reference in its entirety. In that embodiment, an artificial magnetic conductor is resonant at multiple resonance frequencies. That embodiment has properties of an artificial magnetic conductor over a limited frequency band or bands, whereby, near its resonant frequency, the reflection amplitude is near unity and the reflection phase at the surface lies between +/−90 degrees. That embodiment also offers suppression of transverse electric (TE) and transverse magnetic (TM) mode surface waves over a band of frequencies near where it operates as a high impedance surface.

Another implementation of a high-impedance surface, or an artificial magnetic conductor (AMC), which has nearly an octave of +/−90° reflection phase, was developed under DARPA Contract Number F19628-99-C-0080. The size of this exemplary AMC is 10 in. by 16 in by 1.26 in thick (25.4 cm×40.64 cm×3.20 cm). The weight of the AMC is 3 lbs., 2oz. The 1.20 inch (3.05 cm) thick, low permittivity spacer layer is realized using foam. The FSS has a period of 298 mils (0.757 cm), and a sheet capacitance of 0.53 pF/sq.

The measured reflection coefficient phase of this broadband AMC, referenced to the top surface of the structure is shown in FIG. 2 as a function of frequency. A ±90° phase bandwidth of 900 MHz to 1550 MHz is observed. Three curves are traced on the graph, each representing a different density of vias within the spacer layer. For curve AMC1-2, one out of every two possible vias is installed. For curve AMC1-4, one out of every four vias is installed. For curve AMC1-18, one out of every 18 vias is installed. As expected from the effective media model described in application Ser. No. 09/678,128, the density of vias does not have a strong effect on the reflection coefficient phase.

Transmission test set-ups are used to experimentally verify the existence of a surface wave bandgap for this broadband AMC. In each case, the transmission response ($S_{21}$) is measured between two Vivaldi-notch radiators that are mounted so as to excite the dominant electric field polarization for transverse electric (TE) and transverse magnetic (TM) modes on the AMC surface. For the TE set-up, the antennas are oriented horizontally. For the TM set-up, the antennas are oriented vertically. Absorber is placed around the surface-under-test to minimize the space wave coupling between the antennas. The optimal configuration—defined empirically as "that which gives the smoothest, least-noisy response and cleanest surface wave cutoff"—is obtained by trial and error. The optimal configuration is obtained by varying the location of the antennas, the placement of the absorber, the height of absorber above the surface-under-test, the thickness of absorber, and by placing a conducting foil "wall" between layers of absorber. The measured $S_{21}$ for both configurations is shown in FIG. 3. As can be seen, a sharp TM mode cutoff occurs near 950 MHz, and a gradual TE mode onset occurs near 1550 MHz. The difference between these two cutoff frequencies is referred to as a surface wave bandgap. This measured bandgap is correlated closely to the +/−90-degree reflection phase bandwidth of the AMC.

The resonant frequency of the prior art AMC, shown in FIG. 1, is given by Sievenpiper et. al. (*IEEE Trans. Microwave Theory and Techniques,* Vol. 47, No. 11, November 1999, pp. 2059–2074), (Also see Dan Sievenpiper's dissertation, High Impedance Electromagnetic Surfaces, UCLA, 1999) as $f_o=1/(2\pi\sqrt{LC})$ where C is the equivalent sheet capacitance of the FSS layer in Farads per square, and $L=\mu_o h$ is the permeance of the spacer layer, with h denoting the height or thickness of this layer.

In most wireless communications applications, it is desirable to make the antenna ground plane as small and light weight as possible so that it may be readily integrated into physically small, light weight platforms such as radiotelephones, personal digital assistants and other mobile or portable wireless devices. The relationship between the instantaneous bandwidth of an AMC with a non-magnetic spacer layer and its thickness is given by $$\frac{BW}{f_0} = 2\pi\frac{h}{\lambda_0}$$

where $\lambda_0$ is the free space wavelength at resonance where a zero degree reflection phase is observed. Thus, to support a wide instantaneous bandwidth, the AMC thickness must be relatively large. For example, to accommodate an octave frequency range ($BW/f_0=0.667$), the AMC thickness must be at least $0.106\lambda_0$, corresponding to a physical thickness of 1.4 inches at a center frequency of 900 MHz. This thickness is too large for many practical applications.

Accordingly, there is a need for an artificial magnetic conductor, which allows for a wider frequency coverage for a given AMC thickness.

BRIEF SUMMARY

The present invention provides a means to electronically adjust or tune the resonant frequency, $f_o$, of an artificial magnetic conductor (AMC) by controlling the effective sheet capacitance C of its FSS layer.

By way of introduction only, one present embodiment provides an artificial magnetic conductor (AMC) which includes a frequency selective surface (FSS) including a single layer of conductive patches, with one group of conductive patches electrically coupled to a reference potential and a second group of conductive patches forming bias nodes. The FSS further includes voltage variable capacitive elements coupling patches of the one group of conductive patches with patches of the second group and decoupling resistors between the patches of the second group.

Another embodiment provides an AMC which includes a ground plane, a spacer layer disposed adjacent the ground plane and a plurality of vias in electrical contact with the ground plane and extending from a surface of the ground plane in direction of the spacer layer. The AMC further includes a FSS disposed on the spacer layer and including a periodic pattern of bias node patches alternating with ground node patches. The ground node patches are in electrical contact with respective vias of the plurality of vias. The AMC further includes components between selected bias node patches and ground node patches, the components having a capacitance which is variable in response to a bias voltage. The AMC still further includes a network of bias resistors between adjacent bias node patches.

Another embodiment provides an AMC which includes a means for forming a backplane for the AMC and a FSS including means for varying capacitance of the FSS. The AMC further includes a spacer layer separating the means for forming a back plane and the FSS. The spacer layer includes a plurality of vias extending substantially normal to the FSS.

Another embodiment provides an AMC including a FSS including a ferroelectric thin film, a first layer of conductive patches on one side of the ferroelectric thin film, and a second layer of conductive patches on a second side of the ferroelectric film. The patches of the second layer overlapping at least in part patches of the first layer. The AMC further includes a spacer layer including first vias associated with patches of the first layer and second vias associated with patches of the second layer and a backplane conveying bias signals to the first vias and the second vias.

Still another embodiment provides an artificial magnetic conductor (AMC) which includes a frequency selective surface (FSS) having a pattern of conductive patches, a conductive backplane structure, and a spacer layer separating the FSS and the conductive backplane structure. The spacer layer includes conductive vias associated with some but not all patches of the pattern of conductive patches to create a partial forest of vias in the spacer layer.

The foregoing summary has been provided only by way of introduction. Nothing in this section should be taken as a limitation on the following claims, which define the scope of the invention.

BRIEF DESCRIPTION OF SEVERAL VIEWS OF THE DRAWINGS

FIG. 4 is a top view of one embodiment of a reconfigurable artificial magnetic conductor;

FIG. 5 is a cross sectional view taken along line A-A in FIG. 4;

FIG. 6 is a top view of a second embodiment of a reconfigurable artificial magnetic conductor;

FIG. 7 is a cross sectional view taken along line A-A in FIG. 6;

FIG. 8 is a top view of a third embodiment of a reconfigurable artificial magnetic conductor;

FIG. 9 is a cross sectional view taken along line A-A in FIG. 8;

FIG. 16 is a cross sectional view of an alternate embodiment of a reconfigurable artificial magnetic conductor;

DETAILED DESCRIPTION OF THE PRESENTLY PREFERRED EMBODIMENTS

Figure 1:
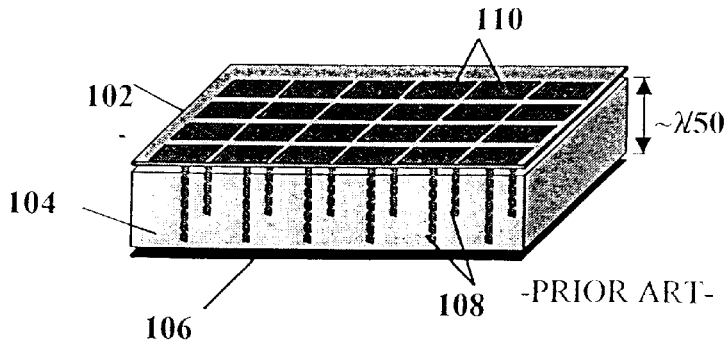
FIG. 1 is a perspective view of a prior art high impedance surface.
Figure 2:
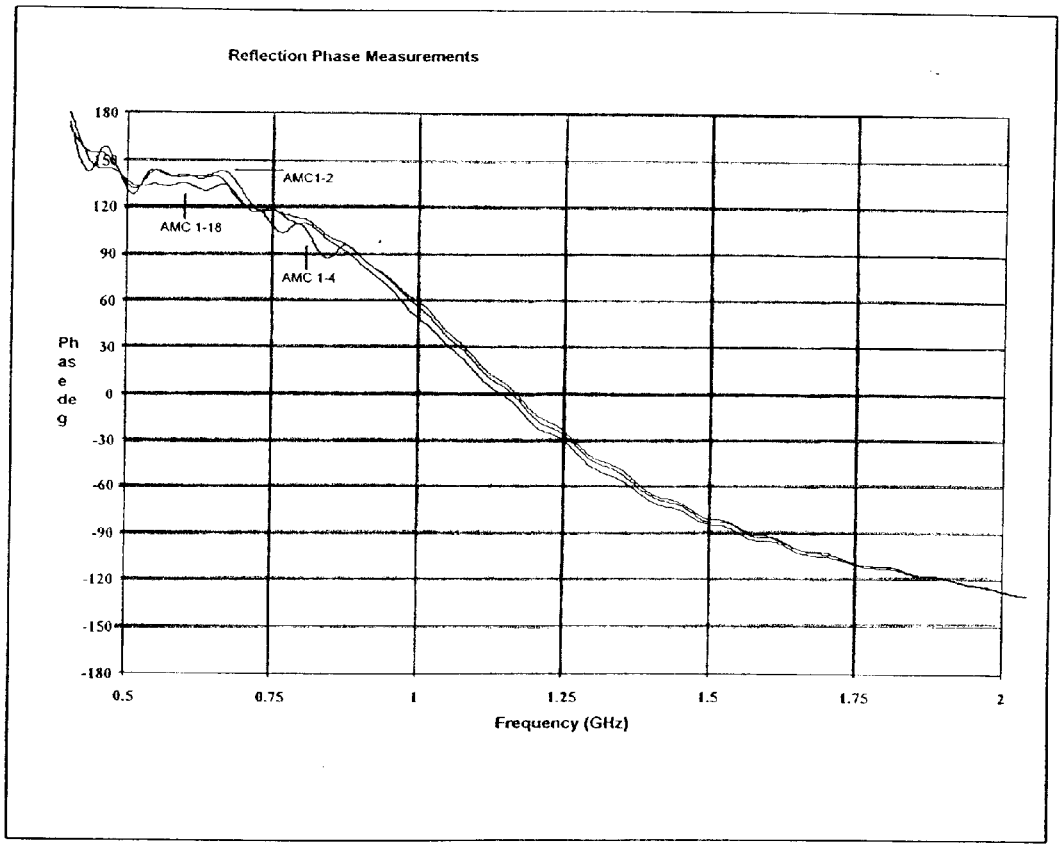
FIG. 2 illustrates measured reflection coefficient phase of a non-reconfigurable high-impedance surface.
Figure 3:
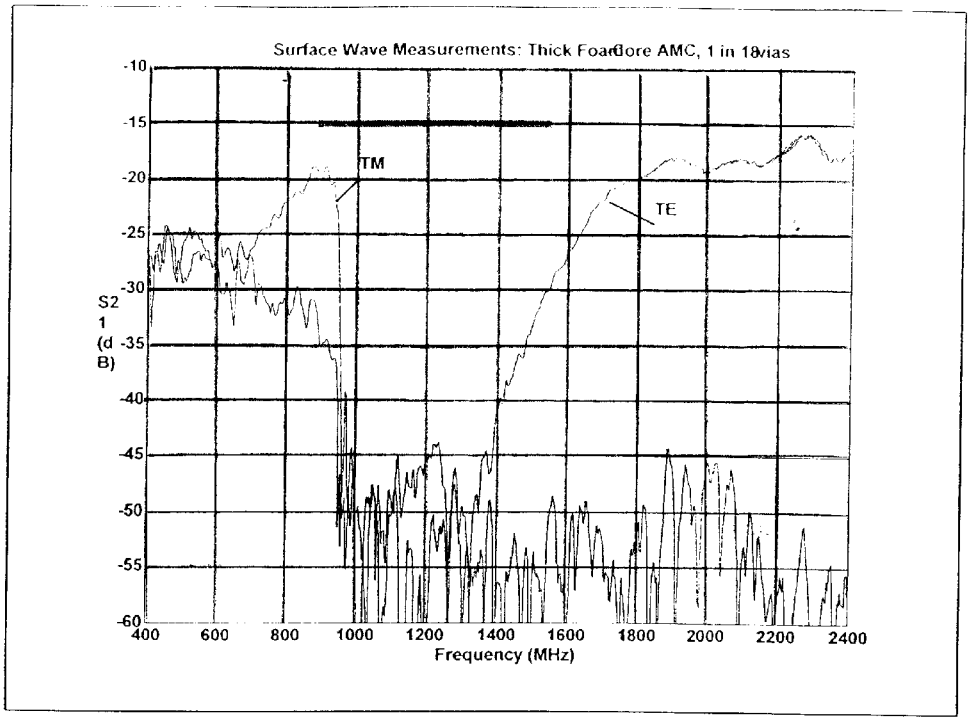
FIG. 3 illustrates transverse electric and transverse magnetic mode surface wave transmission response for a high-impedance surface.

The embodiments of a reconfigurable artificial magnetic conductor (RAMC) described here allow a broader frequency coverage than a passive artificial magnetic conductor (AMC) by varying the capacitance of its frequency selective surface (FSS) in a controlled way to adjust the resonant frequency. Approaches for tuning the capacitance of the FSS layer include (1) the integration of varactor diodes into a single layer FSS where the bias voltage is applied using a resistive lattice which is coplanar with the diode array, and (2) the use of tunable dielectric films in a two-layer FSS.

The merit of building a RAMC is to permit adjacent wire or strip antenna elements to radiate efficiently over a relatively broad tunable bandwidth, up to approximately 3:1 in resonant frequency, when the elements are placed in close proximity to the RAMC surface (as little as $\lambda_0/200$ separation where $\lambda_o$ is the AMC resonant wavelength).

Referring now to FIG. 4, it shows a top view of one embodiment of a reconfigurable artificial magnetic conductor (RAMC) 400. FIG. 5 is a cross sectional view of the RAMC 400 taken along line A-A in FIG. 4. The RAMC 400 has a frequency selective surface (FSS) 402 which has a capacitance which is variable to control resonant frequency of the FSS. The capacitance of the FSS 402 is variable under control of a control circuit which operates in conjunction with the RAMC 400. For example, the RAMC 400 may be integrated with a radio transceiver which controls tuning, reception and transmission of radio signals through an antenna formed in part by the RAMC 400. As part of the tuning process, which selects a frequency for reception or transmission, the control circuit applies appropriate signals to control the capacitance of the FSS 402 to control the resonant frequency of the RAMC 400.

The RAMC 400 further includes a spacer layer 404, a ground plane 406 and metal vias 408. The spacer layer 404 separates the ground plane 406 and the FSS 402. The spacer layer is preferably a dielectric material which, in combination with the vias 408, forms a rodded medium. Each via 408 is preferably associated with a patch 410 of the FSS. The lower terminus of each via is in electrical contact with the ground plane 406. The vias 408 extend through the spacer, electrically coupling one group 412 of conductive patches with the ground plane 406.

The FSS 402 includes a pattern of conductive patches 410. In the illustrated embodiment, the FSS 402 includes a single layer of conductive patches disposed on one side of the spacer layer 408. One group 412 of conductive patches is electrically coupled with a reference potential, which is ground potential in the embodiment of FIGS. 4 and 5. Each patch of the one group 412 is electrically coupled with the via 408 which is associated with the patch.

A second group 416 of conductive patches 410 forms a set of bias nodes. Each patch of the second group 416 is not electrically coupled with its associated via 408. In the illustrated embodiment, this is achieved by leaving a space 417 between the patch and the associated via. This may be achieved in any other suitable manner, such as keeping a layer of insulator material between the top of the via 408 and the conductive patch 410. In this manner, the patches of the second group 416 may be biased at a voltage separate from ground or another reference voltage at which the first group 412 of patches is biased by electrically contacting the associated via 408.

The RAMC 400 further includes a bias line 418 to convey a bias voltage, labeled $V_{bias}$ in FIG. 4. The RAMC 400 still further includes bias resistance elements in the form of decoupling resistors 420 between the patches of the second group 416 and between the bias line 418 and a first row 422 of conductive patches of the second group 416. Any suitable resistors may be used. Their purpose is to provide a common bias voltage to the voltage variable capacitive elements, and yet inhibit the flow of RF current between the patches considered to be bias nodes. In one embodiment, the bias resistance elements are formed using decoupling resistors fabricated using a resistive film. In another embodiment, the bias resistance elements are formed using surface mounted chip resistors. The chip resistors may be preferred in some applications because they provide sufficiently accurate resistance values and are small, lightweight and inexpensive to use. Also, a chip resistor's parasitic shunt capacitance is typically 0.05 pF or less, which is sufficiently low so as not to influence the low capacitance limit of the tunable FSS 402. Typical values for the resistors 420 are in the range 10 KΩ to 2.2 MΩ.

The FSS 402 further includes voltage variable capacitive elements 414 coupling patches of the one group 412 of conductive patches with patches of the second group 416. In the illustrated embodiment of FIG. 4, the voltage variable capacitive elements 414 are embodied as varactor diodes, however microelectrical-mechanical systems (MEMS) based variable capacitors can also be used in this application. (Refer to A. Dec and K. Suyma, "Micromachined Electro-Mechanically Tunable Capacitors and Their Applications to RF ICs," *IEEE Trans. Microwave Theory and Techniques,* Vol 46, No. 12, December 1998, p. 2587.)

One suitable varactor diode is the MA46H202 GaAs tuning diode available from M/A Corn of Lowell, Mass. A varactor or varactor diode is a semiconductor device whose capacitive reactance can be varied in a controlled manner by application of a reverse bias voltage. Such devices are well known, and may be chosen to have particular performance features. The varactor diodes 414 are positioned between alternating patches of the FSS 402. The varactor diodes 414 add a voltage variable capacitance in parallel with the intrinsic capacitance of the FSS 402. The bias voltage for the varactor diodes 414 may be applied using the bias line 418. In the illustrated embodiment, a single bias voltage is shown biasing all patches of the second group 416 of patches. However, in some embodiments, more than one bias voltage may be applied and routed in the RAMC 400 using bias lines such as bias line 418. The magnitude of the bias signals provided on the bias line 418 may be chosen depending on the materials and geometries used in the RAMC 400. Thus, the local capacitance of the FSS 402 may be varied to control the overall resonant frequency of the RAMC 400.

In alternative embodiments, the voltage variable capacitive elements may be formed from or using microelectrical-mechanical switch (MEMS) capacitors, thick film or thin film capacitors, or a bulk tunable dielectric material such as ferroelectric ceramic capacitors. Substitution of these materials and devices is within the purview of those ordinarily skilled in the art of circuit design.

In preferred embodiments, the FSS 402 includes a periodic array of patches 410. In the illustrated embodiment, the conductive patches 410 are made of a metal or metal alloy. In other embodiments, other conductive materials may be used. Further, in the illustrated embodiment, the conductive patches 410 are arranged in a regular pattern and the patches themselves are substantially square in shape. In alternative embodiments, other patch shapes, such as circular, hexagonal, diamond, or triagonal, and other patch patterns may be used. Also, the grounded patches 412 and the bias node patches 416 are not necessarily the same size and shape. Increasing the size of patches 412, while simultaneously decreasing the size of patches 416 and maintaining the same period, will lower the TM mode cutoff frequency, resulting in a larger surface wave bandgap. Particular geometrical configurations may be chosen to optimize performance factors such as resonance frequency or frequencies, size, weight, and so on. In one embodiment, the FSS 402 is manufactured using a conventional printed circuit board process to print the patches 410 on one or both surfaces of the FSS and to produce plated through holes to form the vias. Other manufacturing technology may be substituted for this process.

In the illustrated embodiment, the first group 412 of conductive patches and the second group 416 of conductive patches are arranged in a checkerboard pattern, with patches of the first group 412 alternating with patches of the second group 416 along both x and y axis. In this embodiment, each conductive patch of the second group 416 in the checkerboard pattern is coupled through respective voltage variable capacitive elements 414 to all surrounding conductive patches of the first group 412. In the embodiment of FIG. 4, the decoupling resistors 420 form a square lattice in association with a checkerboard pattern formed by the patches. In alternative embodiments, the biased and grounded patches of the first and second groups are arranged in any suitable alternating pattern in both transverse directions, x and y. The alternating patterns may not match in both the x and they directions and the patterns may not be uniform across the entire AMC.

FIGS. 4 and 5 illustrate conceptually an embodiment of an RAMC realized by integrating varactor diodes into a single layer FSS. This varactor-tuned FSS concept is unique in that bias voltage is not applied or routed through vias from the backplane. Rather, bias voltage is applied to each diode from a coplanar array of RF decoupling resistors which form a square lattice. Resistors lie on the diagonal lines of the array formed by the conductive patches. The resistors connect bias nodes, which are patches unconnected to the vias below them. Every other node in a row or column is a bias voltage node. Ground nodes are patches which are connected to the vias, which in turn are connected to the grounded RF backplane or ground plane.

The result is a checkerboard of ground nodes and bias voltage nodes. Unlike previous designs, no decoupling capacitors are required between bias lines and ground. All surface mounted components are mounted on the same side of the FSS. This saves significant manufacturing costs, which is an important design goal.

FIGS. 4 and 5 illustrate an embodiment in which the anodes of each varactor diode are grounded, and a positive (with respect to ground) bias voltage is applied to the cathodes. In other words, all of the varactor diodes are biased in parallel. However, all of the diodes may be reversed so that the cathodes are grounded and the anodes are biased, but with a negative voltage. Such a change will have no impact on the RF performance of the AMC. It is even conceivable that some varactors in a given AMC design have their anodes grounded, while other varactors in the same AMC have a grounded cathode.

FIG. 6 is a top view and FIG. 7 is a cross sectional view of a second embodiment of a reconfigurable artificial magnetic conductor (RAMC) 400. This embodiment is a "thinned" version of the embodiment shown in FIGS. 4 and 5. The RAMC 400 includes a frequency selective surface (FSS) 402, a spacer layer 404 penetrated by conducting vias 408 and a backplane or ground plane 406. The vias are in electrical contact with the ground plane 406, which is typically kept at ground potential or other reference voltage.

The FSS 402 includes an array of conductive patches 410. Each patch 410 is associated with a via 408 of the spacer layer. Each patch 410 of a first group 412 of patches 410 is electrically coupled with its associated via so that the patch is maintained at ground or other reference potential. Each patch 410 of a second group 416 is not electrically coupled with its associated via but is electrically isolated from the grounded via 408. The patches 410 in the illustrated embodiment are arranged in a checkerboard pattern, alternating grounded patches with biased patches. Voltage variable capacitive elements, such as varactor diodes, couple grounded patches of the one group with biased patches of the second group. A mesh of resistors 420 biases the patches of the second group 416 with a bias voltage from a bias line 418.

In the embodiment of FIGS. 4 and 5, each biased patch of the second group in the checkerboard pattern is coupled through respective voltage variable capacitive elements to all surrounding grounding patches. In the embodiment of FIGS. 6 and 7, biased patches of the second group 416 in the checkerboard pattern are coupled through respective voltage variable capacitive elements to some surrounding grounded patches. The result is a thinned array of varactors, using fewer diodes than the embodiment of FIGS. 4 and 5, which yields a lower FSS effective sheet capacitance for FSS 402.

The merit of this thinned array of varactors in the embodiment of FIGS. 6 and 7 is that the capacitance per unit square can be substantially less than the sheet capacitance of a fully populated FSS. This is desirable when tuning to higher frequencies. In this example of FIGS. 6 and 7, every second row and column of diodes 414 is removed. However, the concept may be extended such that only one of every three or four rows and columns is populated by diodes.

The tuning ratio for resonant frequency of the varactor-tuned AMC 400 is expected to be approximately a 3:1 bandwidth, assuming the use of hyperabrupt junction GaAs tuning diodes. The resistors 420 in the coplanar lattice will also contribute some small parasitic capacitance to the FSS unit cell. However, this is quite small for chip resistors, nominally ~0.05 pF per resistor. It is not expected that this parasitic capacitance will be a noticeable factor in defining the tuning bandwidth, for frequencies of 2 GHz and below. Also, the value of the decoupling resistors that create the resistive lattice is not critical. The only current that flows through the resistive lattice is reverse bias leakage current, typically measured in nanoamps. Practical experience with other biasing circuits indicates that 10 KΩ to 2.2 MΩ chip resistors may be suitably used.

FIG. 8 and FIG. 9 are a top view and a cross sectional view, respectively, of an additional embodiment of a reconfigurable artificial magnetic conductor (RAMC) 800. In FIGS. 8 and 9, the vias associated with the bias patches 416 have been omitted, resulting in a partial forest of vias, where the vias are found only below the ground nodes. None of the bias nodes or patches 416 has an associated via. This increases the period between vias. Vias are required to achieve a TM mode cutoff, and this may be accomplished using the vias 408 below the grounded patches 412 alone. Also, in the illustrated embodiment, the RAMC 800 features a larger size of the grounded patches 412 relative to the bias node patches 416. This helps to lower the normal effective permittivity of the spacer layer 404. These two factors combine to lower the TM mode cutoff frequency, hence increasing the surface wave bandgap. The patches are shown to be square or diamond in shape for both bias and ground nodes, but this is not necessarily required. Other shapes and relative sizes for the patches may be substituted to achieve other design goals.

Figure 10:
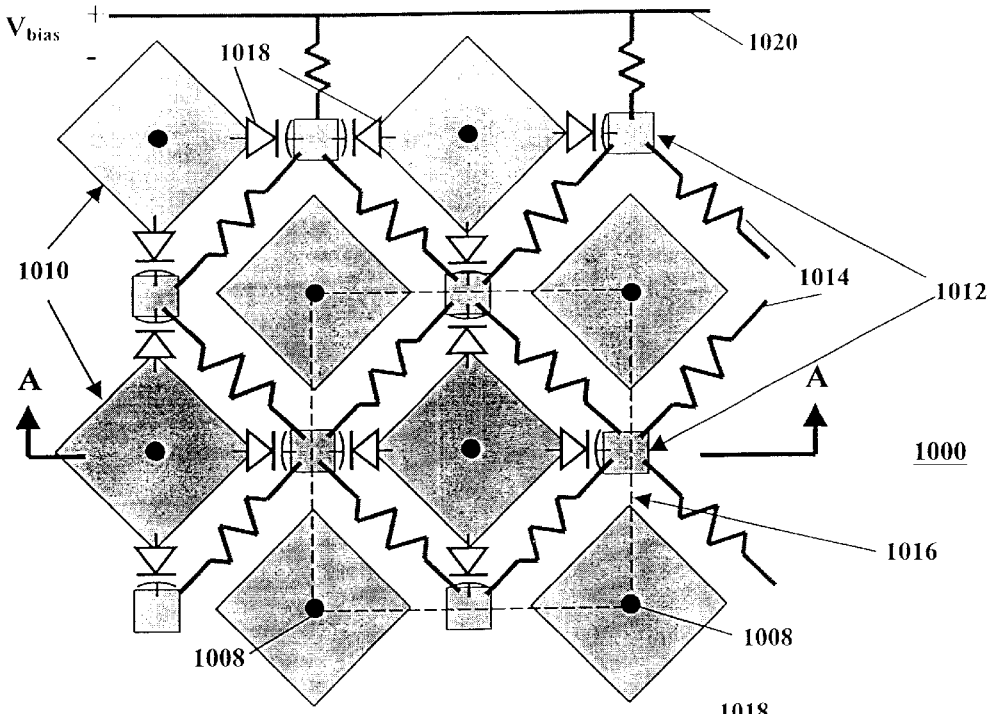
FIG. 10 is a top view of an alternate embodiment of a reconfigurable artificial magnetic conductor.
Figure 11:
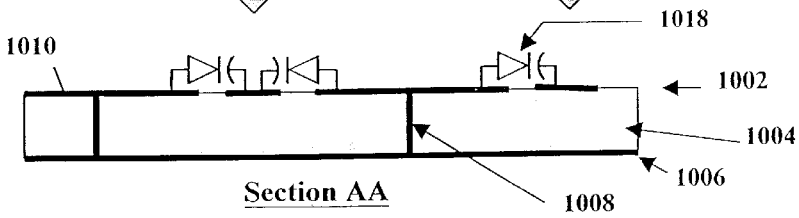
FIG. 11 is a cross sectional view taken along line A-A in FIG. 10.

FIG. 10 is a top view of a portion of a reconfigurable AMC 1000 including a tunable frequency selective surface 1002. FIG. 11 is a cross sectional view of the AMC 1000 taken along line A-A in FIG. 10. In this embodiment, a network of resistors 1014 electrically couples patches 1012 forming bias nodes to the bias line 1020. Patches 1010 are ground nodes and are connected through vias 1008 to the ground plane 1006. Capacitive elements 1018, which are in this example embodied as varactor diodes, couple the bias node patches 1012 and the ground node patches 1010. A unit cell 1016 includes a grounded patch 1010, associated capacitive elements 1018, adjacent resistors 1014 and portions of the adjacent bias node patches 1012. The patches 1012 do not have vias and so are not grounded. In the spacer layer 1004, the missing vias below the bias node patches 1012 result in a larger spacing or period between vias 1008.

In this embodiment, the grounded patches 1010 are much larger in area than the bias node patches 1012. The combination of a larger period between vias 1008 and a larger surface area of the patches 1010 attached to the vias lowers the TM mode cutoff frequency. A thinned array of capacitive elements is employed by connecting diodes to only some of the ground node patches 1010. As shown in FIG. 10, one-half of the ground node patches 1010 are not employed to contact capacitive elements. This reduces the total number of diodes required to populate the AMC 1000, thereby reducing cost and weight of the AMC 1000. Further, the effective sheet capacitance is reduced and the maximum tunable frequency is increased in this manner.

Figure 12:
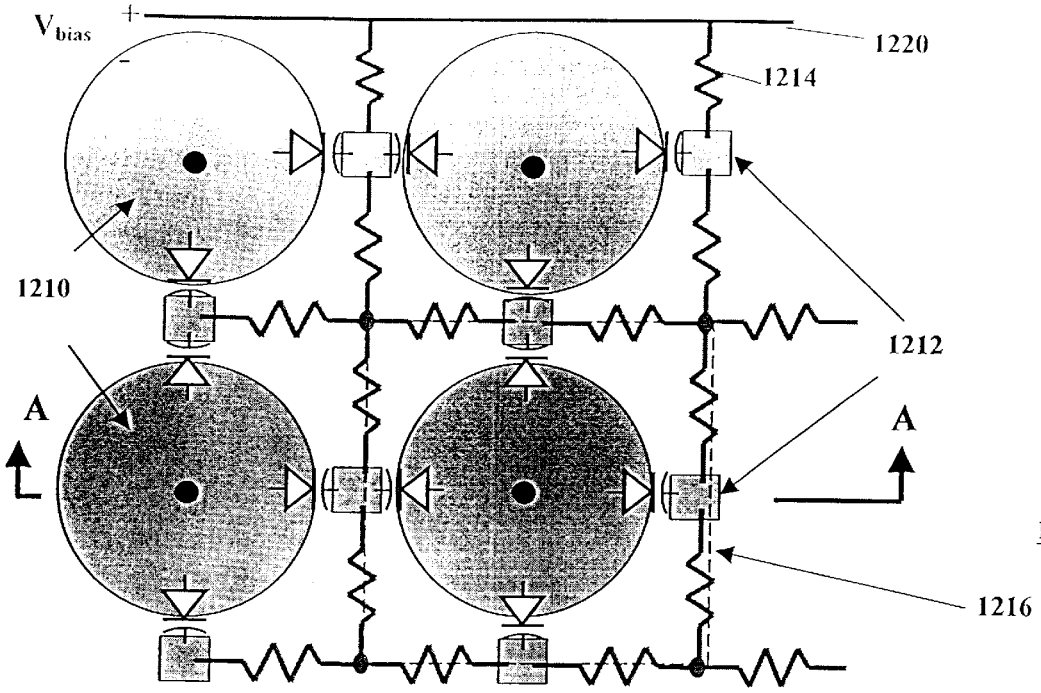
FIG. 12 is a top view of an alternate embodiment of a reconfigurable artificial magnetic conductor.
Figure 13:
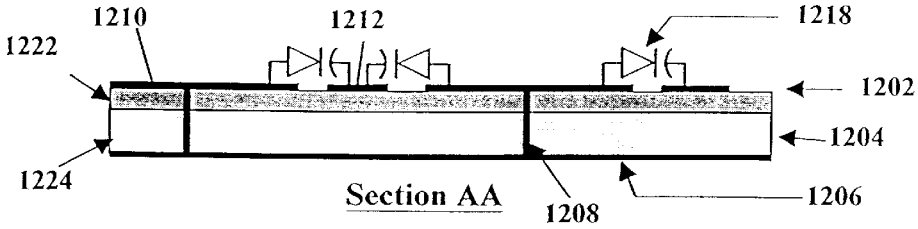
FIG. 13 is a cross sectional view taken along line A-A in FIG. 12.

FIG. 12 is a top view of a portion of a reconfigurable AMC 1200 including a tunable frequency selective surface 1002. FIG. 13 is a cross sectional view of the AMC 1200 taken along line A-A in FIG. 12. Similar to the AMC 1000 of FIG. 10, the AMC 1200 includes oversized patches 1210 coupled through vias 1208 to the ground plane 1206. Reduced-sized bias node patches 1212 are coupled through a network of bias resistors 1214 to a bias line 1220. Capacitive elements 1218, embodied as varactor diodes, couple the bias node patches 1212 and the ground node patches 1210. A unit cell 1216 includes a grounded patch 1210, associated capacitive elements 1218, adjacent resistors 1214 and portions of the adjacent bias node patches 1212. The patches 1212 do not have vias to the ground plane 1206 and so are not grounded.

In this embodiment, the bias resistors 1214 are arranged in a square mesh, in columns and rows which run between the patches 1210, 1212. As in FIG. 10, no vias are used below the small patches 1212 which form the bias nodes. The combination of a larger spacing or period between vias 1208 and a larger surface area of the patch 1210 associated with the vias lowers the TM mode cutoff frequency, extending the surface wave bandgap.

Also in the illustrated embodiment, the dielectric material of the spacer layer 2604 of the reconfigurable AMC 1200 includes a layer 1222 of FR4 or similar material and a layer 1224 of radiofrequency (RF) grade foam such as Rohacell polymethacrylimide rigid foam, available from Rohm GmbH, Darmstadt, Germany. Use of RF foam may be preferable for reducing the weight of the AMC 1200. If the foam layer 1224 is used, the vias 1220 may be inserted by hand or other means, rather than using printed circuit board manufacturing techniques.

Figure 14:
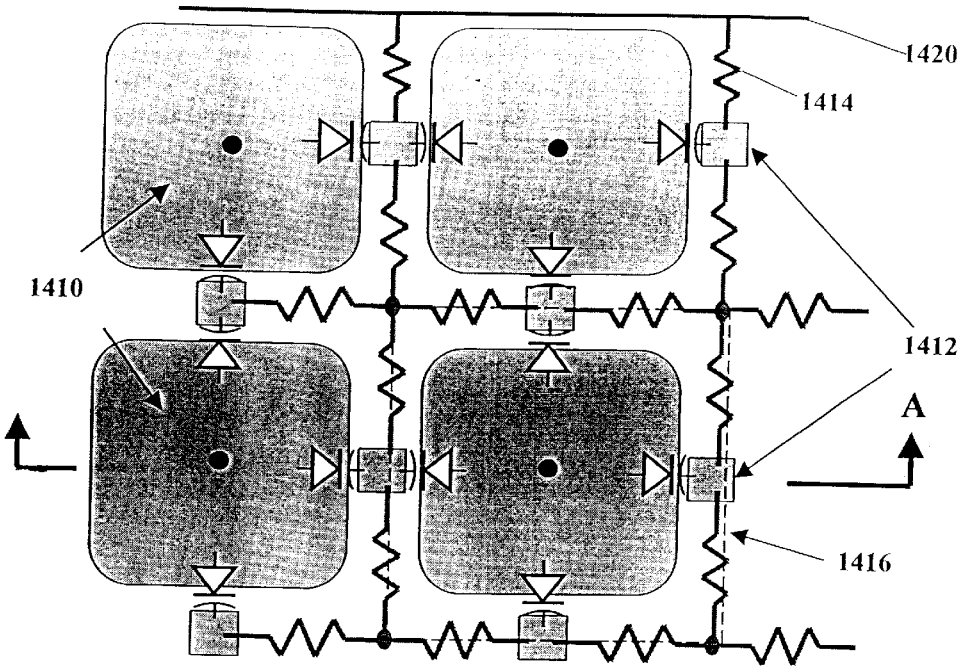
FIG. 14 is a top view of an alternate embodiment of a reconfigurable artificial magnetic conductor.
Figure 15:
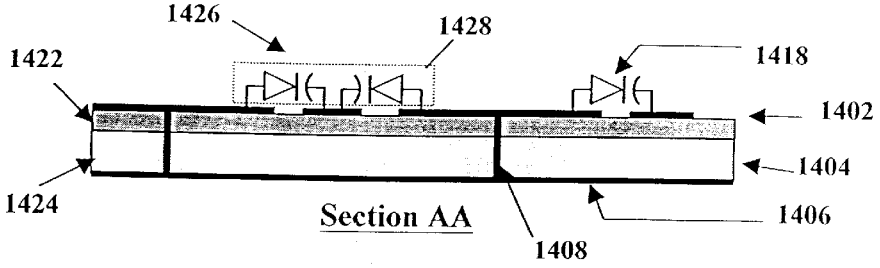
FIG. 15 is a cross sectional view taken along line A-A in FIG. 14.

FIG. 14 is a top view of a portion of a reconfigurable AMC 1400 including a tunable frequency selective surface 1402. FIG. 15 is a cross sectional view of the AMC 1400 taken along line A-A in FIG. 14. Similar to the AMCs 1000, 1200 of FIGS. 10 and 12, the AMC 142800 includes oversized patches 1410 coupled through vias 1408 to the ground plane 1406. Patches 1412 do not have vias to the ground plane 1406 and so are not grounded. The reduced-sized bias node patches 1412 are coupled through a network of bias resistors 1414 to a bias line 1420. Capacitive elements 1418, embodied as varactor diodes, couple the bias node patches 1412 and the ground node patches 1410. A unit cell 1416 includes a grounded patch 1410, associated capacitive elements 1418, adjacent resistors 1414 and portions of the adjacent bias node patches 1412.

Again in this embodiment, the bias resistors 1414 are arranged in a square mesh. In this embodiment, the grounded patches 1410 are square with rounded corners. Preferably, the grounded patches cover as much surface area as possible and maximize the effective radius of the patch 1410. In the embodiment of FIG. 26, the effective radius of the patches 1410 is the radius of the circular patch. In the embodiment of FIG. 10, the effective radius of the patches 1010 is a portion of the diagonal of a square patch 1010. These preferred geometries are beneficial to lower the normal permeability of the FSS 2802, which helps to increase the TE mode cutoff frequency.

Again, in the embodiment of FIG. 14, no vias are used below the bias node patches 1412. As described above, the larger patch 1410 surface area and the larger spacing between vias 1408 lowers the TM mode cutoff frequency and extends the surface wave bandgap. The patches 1412 may be made as small as possible while still permitting reliable connection of bias resistors 1414 and the capacitive elements 1418.

Also in this embodiment, the frequency selective surface 1402 includes a multilayer dielectric substrate to reduce the weight relative to a thick fiberglass or FR4 board. Also, if the height of the spacer layer 1404 is 0.25 inches (1.0 cm) or greater, FR4 may not be available. Thus, the spacer layer 1404 includes a layer 1422 of FR4 combined with a layer 1424 of foam, as described above.

Further, in the embodiment of FIG. 14, the capacitive elements 1418 are combined as a pair 1426 as varactor diodes contained in a single package 1408. Such diode pairs 1426 are commercially available with three terminals including a common cathode and two anodes. The common cathode may be soldered or otherwise joined to a bias node 1412 while the two anodes may be joined to adjacent ground node patches 2810. Common anode pairs may also be employed if the polarity of the bias voltage is reversed. Use of such devices may reduce the parts count, manufacturing cost and size and weight of the finished AMC 2800.

FIG. 16 is a cross sectional view of a sixth embodiment of a reconfigurable artificial magnetic conductor (RAMC) 1600. The RAMC 1600 includes a frequency selective surface (FSS) 1602, a dielectric spacer layer 1604, a backplane or ground plane 1606, and conductive vias 1608 extending from the ground plane 1606 through the spacer layer 1604 to form a rodded medium.

The FSS 1602 includes a tunable dielectric film 1614, which may be a ferroelectric material such as Barium Strontium Titanate Oxide (BSTO), a first layer 1610 of conductive patches on one side of the tunable dielectric film 1614 and a second layer 1612 of conductive patches on a second side of the tunable dielectric film. The patches of the second layer 1612 overlap at least in part patches of the first layer 1610. The vias 1608 include first vias 1618 associated with patches of the first layer 1610 and second vias 1616 associated with patches of the second layer 1612. The backplane 1606 includes a stripline bias distribution layer 1620 which conveys bias signals to the first vias 1618 and the second vias 1616. In one embodiment, the backplane 1606 is fabricated using conventional printed circuit board techniques to form and route the stripline conductors interior to the backplane, and vias through the backplane to couple the stripline conductors to the vias 1008 of the spacer layer 1604. A bias voltage source 1622 provides a bias voltage to some stripline conductors, vias 1616 and their associated patches 1610. Ground potential or other reference voltage is provided to other vias 1618 and their associated patches 1612.

The reconfigurable or tuned AMC 1600 is an extension of the varactor-tuned embodiments of FIGS. 4–9 where varactor diodes are replaced by a film of voltage tunable dielectric, which may be a classic ferroelectric (FE) material or a composite FE material containing dopants. This tunable dielectric film separates opposing patches of the first layer 1610 and the second layer 1612 in a capacitive FSS 1602. The permittivity of the tunable dielectric material is highest when no biasing electric field is applied, and then it becomes lower as a DC biasing electric field is applied. Either polarity will work to bias the FE materials. Bias voltage for the FE material (capacitors) is applied to vias 1616 that terminate on one surface of the FSS while opposing patches on the other side of the FSS are grounded through vias 1618. As the bias voltage is increased from zero, the FSS capacitance falls, and the RAMC 1600 tunes to a higher resonant frequency. A maximum decrease of 50% to 75% in tunable dielectric material permittivity is anticipated, depending on the material, which implies an AMC tuning ratio of 1.41:1 to 2:1.

Figures 17, 18:
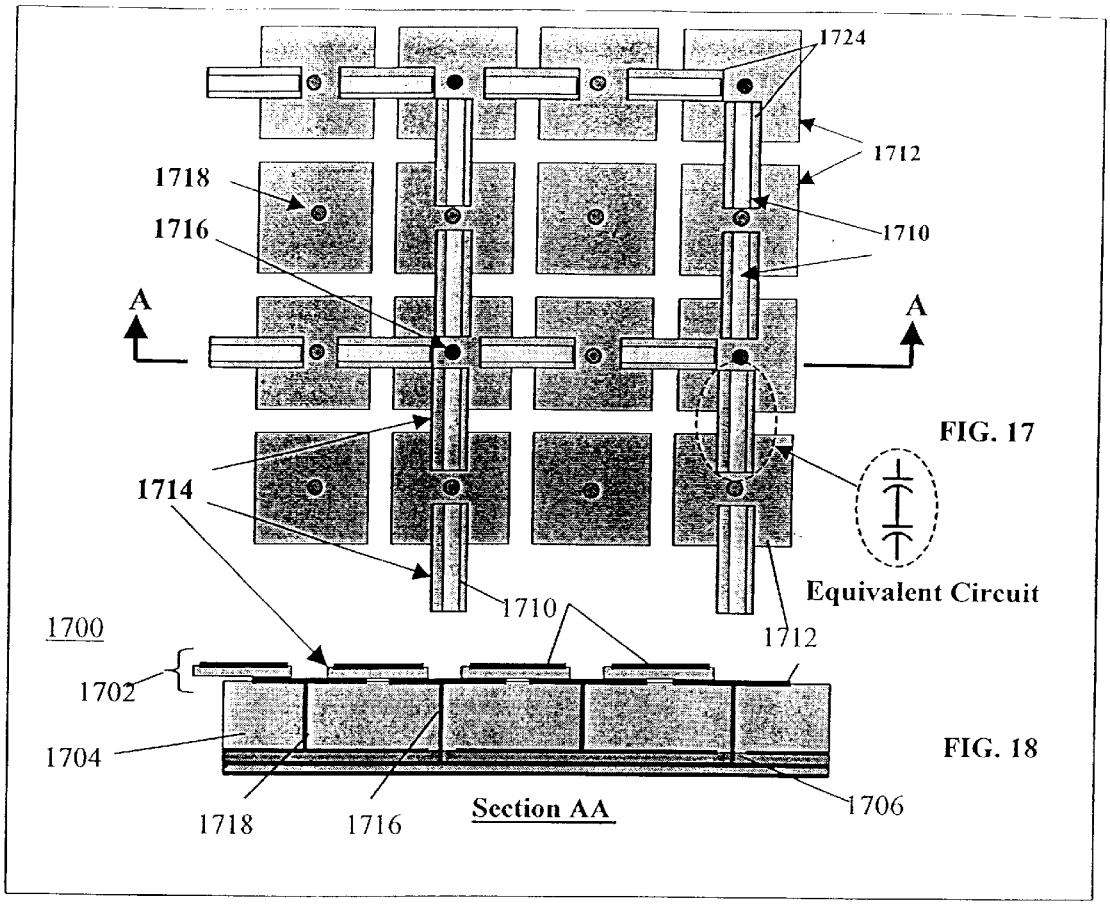
FIG. 17 is a top view of an alternate embodiment of a reconfigurable artificial magnetic conductor.
FIG. 18 is a cross sectional view taken along line A-A in FIG. 11.

Tunable dielectric materials are characterized by very high relative dielectric constants, typically between 100 and 1000. Furthermore, the desire for relatively low control voltages, less than 100 VDC, implies a thin vertical separation between FSS patches. These factors conspire to raise the FSS sheet capacitance to values higher than what may be desirable in a practical design. A potential solution is to limit the physical extent where the tunable dielectric film and the top level of patches are fabricated, such that they do not necessarily cover the entire surface. FIG. 17 is a top view of another embodiment of a tunable or reconfigurable artificial magnetic conductor (RAMC) 1700. FIG. 18 is a cross sectional view of the RAMC 1700 taken along line A-A in FIG. 17. The RAMC 1700 includes a frequency selective surface (FSS) 1702, a dielectric spacer layer 1704, and a backplane 1706.

The spacer layer 1704 is perforated by grounded vias 1718 and biased vias 1716. Each via 1716, 1718 is associated with a patch or metal portion of the FSS 1702. The grounded vias are electrically coupled to a ground plane of the backplane 1706 and are electrically coupled with their associated metal patches of the FSS 1702. The biased vias are electrically coupled to one or more bias signal lines of the back plane 1706 and are electrically coupled with their associated metal portions of the FSS 1702.

The FSS 1702 includes lower FSS metal patches 1712, tunable dielectric film portions 1714, and upper FSS metal portions 1710. In the embodiment of FIGS. 17 and 18, the tunable dielectric thin film 1714 is applied selectively in strips 1724 between some of the lower FSS metal patches 1712. Where the strips 1724 intersect, a biased via 1716 biases its associated patch 1712 to a bias voltage. The upper metal patch 1710 is much smaller than the lower metal patches, and it forms the center electrode to create a series pair of tunable capacitors. The equivalent circuit is shown in FIG. 17. By limiting the upper metal patch 1710 to a small surface area, and designing the ferroelectric capacitors to be series pairs, then the net capacitance of the tunable dielectric capacitors can be made sufficiently small, in the range of 1 to 10 pF. This capacitance range is needed for practical RAMC applications in the UHF and L-band frequency range (300 MHz to 2 GHz).

From the foregoing, it can be see that the present invention provides a reconfigurable artificial magnetic conductor (RAMC) which allows for a wider frequency coverage with a thinner RAMC thickness. The sheet capacitance of the frequency selective surface of the RAMC is controlled, thus controlling its high impedance properties. In one embodiment, varactor diodes are integrated into the frequency selective surface where the bias voltage is applied through a coplanar resistive lattice. In another embodiment, a tunable dielectric film is integrated into a two-layer frequency selective surface, which is biased through a stripline embedded in the backplane. However, a combination of tunable dielectric film and resistive biasing film may be integrated to eliminate the need for a multi-layer RF backplane. The biasing film and tunable dielectric film can be coplanar films, each covering a separate and distinct area of the FSS patches. This can be visualized by replacing the varactor diodes of FIG. 8 above with the tunable dielectric strips 1124 of FIG. 11 above.

The present embodiments describe RAMCs whose surface impedance is isotropic, or equal for both transverse polarizations of electric fields. This is possible due to the symmetry of the patches and biasing networks. It is possible to spoil this symmetry, for example by employing rectangular patches in place of square patches. Such asymmetry can cause the AMC resonance to be polarization specific, but the AMC will still exhibit properties of a high impedance surface, and it will still be tunable. However, the surface wave bandgap may be adversely affected, or even disappear.

While a particular embodiment of the present invention has been shown and described, modifications may be made. It is therefore intended in the appended claims to cover such changes and modifications which follow in the true spirit and scope of the invention.

What is claimed is:

1. An artificial magnetic conductor (AMC) comprising:

a frequency selective surface (FSS) including a single layer of conductive patches, one group of conductive patches being electrically coupled to a reference potential, a second group of conductive patches forming bias nodes;

voltage variable capacitive elements coupling patches of the one group of conductive patches with patches of the second group, and decoupling resistors connected between the patches of the second group.

2. The AMC of claim 1 further comprising:

a bias line conveying a bias voltage.

3. The AMC of claim 2 further comprising:

decoupling resistors connected between the bias line and a first row of conductive patches of the second group.

4. The AMC of claim 3 wherein the bias voltage is variable for tuning resonant frequency of the AMC.

5. The AMC of claim 1 further comprising:

a ground plane;

a spacer layer separating the ground plane and the FSS; and vias through the spacer layer which electrically couple conductive patches of the one group with the ground plane.

6. The AMC of claim 1 wherein the first group of conductive patches and the second group of conductive patches are arranged in an alternating pattern in both transverse directions.

7. The AMC of claim 1 wherein the first group of conductive patches and the second group of conductive patches are arranged in a checkerboard pattern.

8. The AMC of claim 7 wherein each conductive patch of the second group in the checkerboard pattern is coupled through respective voltage variable capacitive elements to all surrounding conductive patches of the first group.

9. The AMC of claim 7 wherein conductive patches of the second group in the checkerboard pattern are coupled through respective voltage variable capacitive elements to some surrounding conductive patches of the first group.

10. The AMC of claim 7 wherein the decoupling resistors form a regular mesh.

11. The AMC of claim 10 wherein the decoupling resistors form a square lattice in association with the checkerboard pattern.

12. The AMC of claim 1 wherein the voltage variable capacitive elements comprise varactor diodes.

13. The AMC of claim 1 wherein the voltage variable capacitive elements comprise voltage variable microelectrical-mechanical system (MEMS) capacitors.

14. The AMC of claim 1 wherein the voltage variable capacitive elements comprise voltage variable thick film capacitors.

15. The AMC of claim 1 wherein the voltage variable capacitive elements comprise voltage variable thin film capacitors.

16. The AMC of claim 1 wherein the voltage variable capacitive elements comprise a bulk tunable dielectric material.

17. The AMC of claim 16 wherein the voltage variable capacitive elements comprise ferroelectric ceramic capacitors.

18. An artificial magnetic conductor (AMC) comprising:

a ground plane;

a spacer layer disposed adjacent the ground plane;

a plurality of vias in electrical contact with the ground plane and extending from a surface of the ground plane in direction of the spacer layer;

a frequency selective surface disposed on the spacer layer and including:

a periodic pattern of bias node patches alternating with ground node patches, the ground node patches being in electrical contact with respective vias of the plurality of vias;

components between selected bias node patches and ground node patches, the components having a capacitance which is variable in response to a bias voltage; and a network of bias resistance elements connected between adjacent bias node patches.

19. The AMC of claim 18 wherein the bias resistance elements comprise decoupling resistors fabricated using a resistive film.

20. The AMC of claim 18 wherein the bias resistance elements comprise surface mounted chip resistors.

21. The AMC of claim 18 wherein the components comprise varactor diodes.

22. The AMC of claim 18 wherein the components include respective components coupled between a bias node patch and each surrounding ground node patch.

23. The AMC of claim 22 wherein the components comprise varactor diodes.

24. The AMC of claim 18 wherein the components include respective components coupled between alternate ground node patches and each surrounding bias node patch.

25. The AMC of claim 18 wherein the plurality of vias includes a respective via for each bias node patch and each ground node patch, only the each ground node patch being in electrical contact with its respective via.

26. The AMC of claim 18 wherein the plurality of vias omit vias associated with the bias node patches.

27. An artificial magnetic conductor (AMC) comprising:

means for forming a backplane for the AMC;

a frequency selective surface (FSS) including means for varying effective sheet capacitance of the FSS, including resistive means for distributing a common bias voltage; and a spacer layer separating the means for forming a back plane and the FSS, the spacer layer including a plurality of vias extending substantially normal to the FSS.

28. The AMC of claim 27 wherein the means for varying capacitance of the FSS comprises:

a pattern of conductive patches printed on one side of the FSS, one group of conductive patches forming ground nodes, a second group of conductive patches forming bias nodes;

voltage variable capacitive elements responsive to the common bias voltage between a respective bias node and a respective ground node; and a bias line for biasing the bias nodes.

29. The AMC of claim 28 wherein the means for forming a backplane comprises a ground plane in electrical contact with vias of the plurality of vias respectively associated with the ground nodes for grounding the ground nodes.

30. The AMC of claim 28 wherein the resistive means comprises:

a network of resistors disposed between the bias nodes.

31. The AMC of claim 27 wherein the means for varying capacitance comprises:

a tunable dielectric thick or thin film;

patterns of overlapping conducting patches on respective sides of the tunable dielectric film, each patch being associated with a via, vias associated with patches on a first side being in electrical contact with a bias line of the means for forming a backplane and vias associated with patches on a second side being in electrical contact with a ground line of the means for forming a backplane.

32. An artificial magnetic conductor (AMC) comprising:

a frequency selective surface (FSS) including a tunable dielectric thick or thin film, a first layer of conductive patches on one side of the tunable dielectric film, a second layer of conductive patches on a second side of the tunable dielectric film, patches of the second layer overlapping at least in part patches of the first layer, and decoupling resistance connected between the conductive patches of at least one of the first layer of conductive patches and the second layer of conductive patches;

a spacer layer including first vias associated with patches of the first layer and second vias associated with patches of the second layer; and a backplane conveying bias signals to the first vias and the second vias.

33. The AMC of claim 32 further comprising a bias voltage source providing the bias signals to vary permittivity of the tunable dielectric film.

34. An artificial magnetic conductor (AMC) comprising:

a frequency selective surface (FSS) including a tunable dielectric film, a first layer of conductive patches on one side of the tunable dielectric film, and a second layer of conductive patches on a second side of the tunable dielectric film, patches of the second layer overlapping at least in part patches of the first layer;

a spacer layer including vias associated with patches of the first layer;

a backplane conveying bias signals to the first vias; and a resistive biasing network to apply a bias voltage to the tunable dielectric film.

* * * * *